United States Patent [19]

Benge et al.

[11] Patent Number: 4,735,339

[45] Date of Patent: Apr. 5, 1988

[54] RETORTABLE PACKAGES

[75] Inventors: Terence A. Benge, Faringdon; John Chapman, Wantage; Alan J. Maskell, Harwell, all of United Kingdom

[73] Assignee: Metal Box Public Limited Company, Berkshire, England

[21] Appl. No.: 54,263

[22] Filed: May 26, 1987

[30] Foreign Application Priority Data

May 29, 1986 [GB] United Kingdom ..... 8613029

[51] Int. Cl.[4] ..... B65D 41/00

[52] U.S. Cl. ..... 220/359; 53/477; 53/478; 53/484

[58] Field of Search ..... 220/359, 66; 150/55; 53/477, 478, 484, 485; 426/127, 106, 131, 398, 399

[56] References Cited

U.S. PATENT DOCUMENTS

| | | | |
|---|---|---|---|
| 4,350,263 | 9/1982 | Hoffman | 220/359 |
| 4,542,029 | 9/1985 | Caner et al. | 220/359 |
| 4,605,142 | 8/1986 | Itoh et al. | 220/359 |

*Primary Examiner*—George T. Hall

*Attorney, Agent, or Firm*—Wood, Dalton, Phillips, Mason & Rowe

[57] ABSTRACT

A retortable, hydraulically solid, sealed package (10) containing a liquid or semi-liquid food product (24) comprises a thermoplastics container (12) formed by a thermo-forming process and a heat-shrinkable thermoplastics closure diaphragm (20). The closure diaphragm is heat-sealed to a rim (18) of the container after the headspace above the product has been evacuated, and is subsequently subjected to external pressure so as to be non-elastically stretched and made to lie wholly in contact with the enclosed product. When retorted (e.g. for sterilization) the package suffers no visible deformation of the container (12), despite the considerable volume shrinkage of the container which may occur. The loss of volume caused by this volume shrinkage is accommodated by a reduction in the concavity of the diaphragm (20) caused by a corresponding heat-induced shrinkage of the diaphragm material. The diaphragm continues to exhibit a pleasing, smooth or smoothly curving surface, and the retorted package has a consumer-acceptable appearance.

11 Claims, 2 Drawing Sheets

RETORTABLE PACKAGES

This invention relates to the production of retortable packages charged with a product (particularly a liquid or semi-liquid food product). In applicants' British Patent Specification No. GB. 2,067,157B the enclosure of the package comprises a container of a thermoplastics material, and a diaphragm which is sealed to a rim formed at the charging or mouth end of the container. The diaphragm is made from metal foil, and is heat sealed to the container rim by means of a thin layer of a thermoplastics material which is carried by the metal foil. After closure the package is thermally processed in, for example, a steam, steam/air or underwater retort to achieve pasteurisation or sterilization.

With retortable packages it is commercially important that after retorting the enclosure should not only be intact but also should exhibit no significant visible signs of deformation, so as to have a consumer-acceptable appearance. A further requirement is that the enclosure can be stood stably upright, without rocking, on a display shelf or the like.

In our said British Patent Specification No. GB 2067157B (to which the reader's attention is hereby directed), Applicants have disclosed a sealing process by which retortable packages of a liquid or semi-liquid food product are made hydraulically solid. A headspace which is initially present in a thermoplastics container above the contained product is eliminated by evacuation of the headspace gas before sealing with an aluminium diaphragm; after sealing, an external pressure is applied to the diaphragm so as to stretch it non-elastically and redistribute the product lying adjacent the diaphragm. The diaphragm therefore has a dished, outwardly concave configuration, and lies wholly in contact with the product.

Using the process of patent specification No. 2067157 applicants have been able to produce enclosures which have a high and commercially satisfactory degree of dimensional stability providing that the containers have been subject to only a small degree of volume shrinkage (e.g. 3% or less) during retorting. However, in seeking to use the process with containers subject to larger degrees of volume shrinkage (e.g. greater than 3%), Applicants have met difficulty with substantial distortion of the enclosure caused by the retorting process. This distortion is manifest in two ways, namely: (a) an outward bulging and/or buckling of the base of the container, and (b) an outward bulging and/or unsightly wrinkling of the metal diaphragm at the top of the enclosure. Usually (a) or (b) alone is present, but on some occasions both (a) and (b) are present, and/or the side wall of the container deforms instead of, or in addition to, the container base.

With containers having a large plan area in relation to their height, in particular shallow trays, the degree of distortion involved may be visually and mechanically insignificant and therefore may be considered to be commercially acceptable. For containers such as pots, tubs and bowls having a relatively small plan area in relation to their height, however, the distortion will be more evident to the potential consumer and, in the case of container base deformation, may result in the inability of the package to stand stably upright. Particularly, therefore, for such containers which are subject to a substantial degree of volume shrinkage during retorting, there exists a requirement to control distortion of the enclosure caused by the volume shrinkage of the container in such a way that commercially acceptable packages may result.

According to one aspect of the present invention, there is provided a retortable package having a product contained within an enclosure, the enclosure comprising a container having a base and an upstanding side wall extending to a rim, at least the side wall being moulded from a thermoplastics material and being subject to shrinkage during a retorting process, the enclosure further comprising a diaphragm which is heat-sealed to the container rim and dished on to the product in the container so as to render the package substantially hydraulically solid, said diaphragm being of thermoplastics material and being heat-shrinkable so as during a subsequent retorting process to shrink and by reducing the concavity of the diaphragm substantially to compensate for volume shrinkage of the container caused by the retorting process.

The enclosure may thus exhibit no readily visible effects of retorting. In the ultimate case, the dished diaphragm becomes generally planar.

Satisfactory results have been obtained by Applicants using containers made of polyproplenB and laminates incorporating that material, but Applicants believe that the invention is applicable to containers formed from other plastics materials and of either single-layer or multi-layer (laminated) construction. Furthermore, although being of particular application to thermoplastics containers which are thermoformed from sheet materials, the invention may be used with containers made by other forming methods, for example, by stretch-blow moulding a tube parison or tubular preform, and may include containers in which the base is not integral with but instead is attached to the side wall.

According to a second aspect of the present invention, there is provided a method of making a retortable package of a product comprising the steps of:

(a) forming a container to have a base and an upstanding side wall extending to a rim, at least the side wall being moulded from thermoplastics material and being subject to shrinkage during a retorting process;

(b) charging the container with the product to leave a headspace below the rim;

(c) heat-sealing a thermoplastics diaphragm peripherally to the rim;

(d) rendering the diaphragm material dished so as to cause the diaphragm, after heat-sealing, to occupy the headspace and make full contact with the product, the package thereby being rendered hydraulically solid; and (e) rendering the diaphragm heat-shrinkable so as during a retorting process on the hydraulically solid package to shrink and, by reducing the concavity of the diaphragm, substantially to compensate for volume shrinkage of the container caused by the retorting process.

Other aspects and features of the present invention will appear from the description that follows hereafter and from the claims appended at the end of the description.

The practice of the present invention will now be described and discussed with reference to the accompanying drawings in which.

Figure 4:
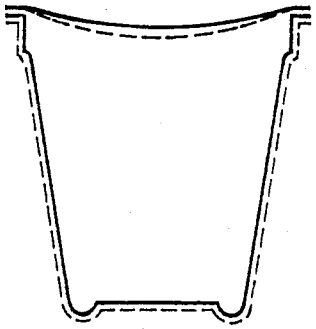
Figure 5:
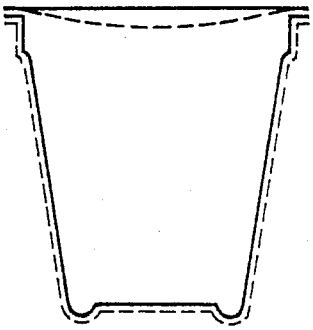
Figure 6:
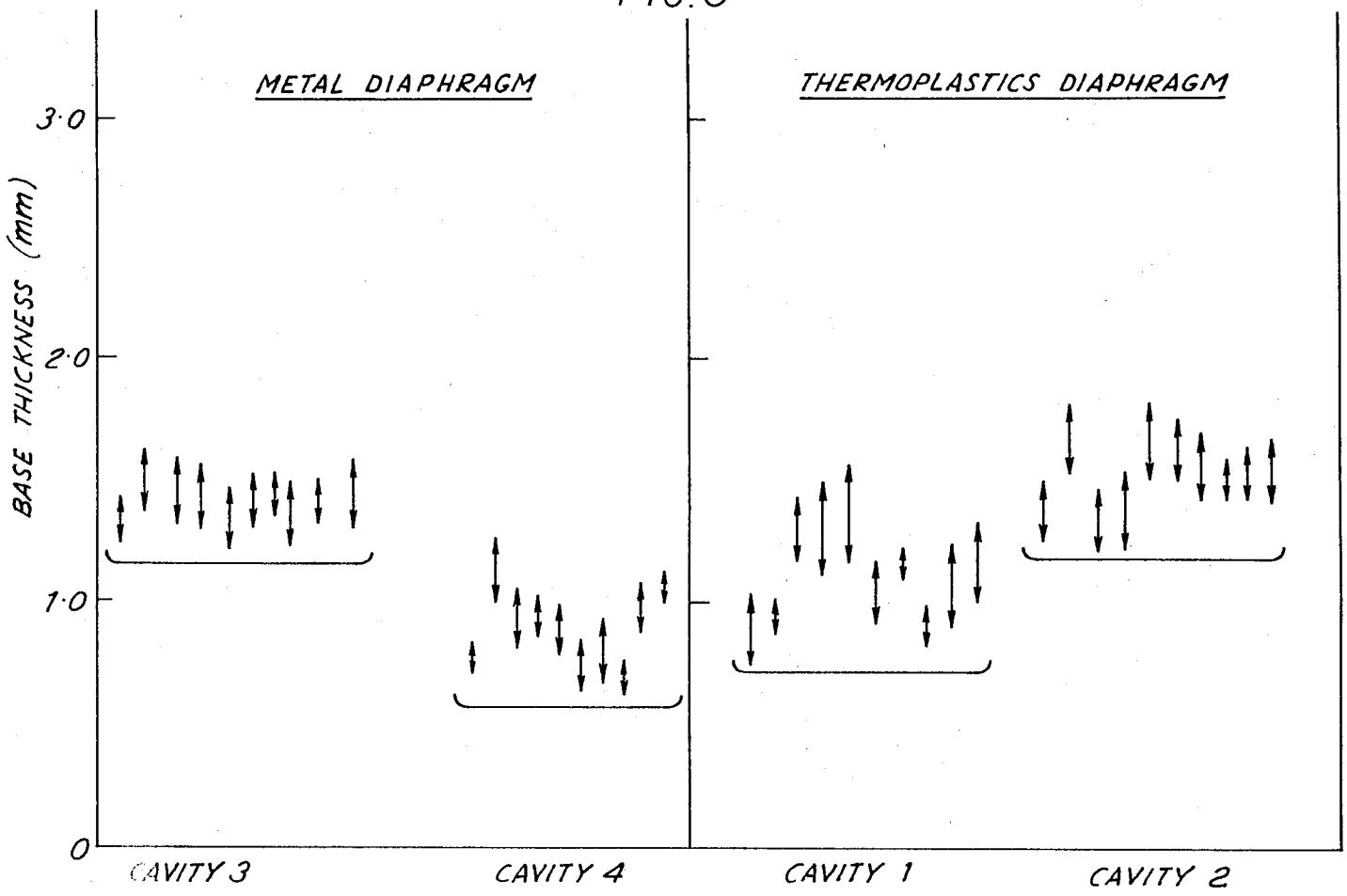

FIGS. 4 and 5 similarly show two plastics-lidded packages according to the present invention, as they appeared after having been subjected to a retoring process; and FIG. 6 graphically shows the range of base thicknesses measured on the forty individual containers used in a comparison of the retort performances of packages having metal diaphragms with plastics-lidded packages in accordance with the invention.

For the purpose of comparison the packages before retorting are represented by the broken lines in FIGS. 2 to 5.

The tests now to be described were all performed upon packages formed using upwardly tapered containers of circular cross-section, of the style generally known as 71 mm dairy pots. The containers had a rim diameter to pot height ratio of approximately 1:1, and were produced by thermoforming co-extruded multilayer thermoplastics laminate or sheet. The laminate was formed of two relatively thick polypropylene (PP) skin layers having sandwiched therebetween a thin oxygen barrier layer of polyvinylidene chloride (PVdC) and thin adhesive layers on either side of the barrier layer.

For the purposes of the tests the liquid or semi-liquid food product which the packages would contain commercially was simulated by a starch solution.

The containers were closed after they had been filled with product so as to leave a headspace, and the headspace had subsequently been evacuated. A plane flexible web of material was then heat-sealed to the container rim so as to form a diaphragm enclosing the product and headspace within the container, after which the diaphragm was subjected to an external fluid pressure over the headspace so as to be stretched inwards into full contact with the product.

The movement of the diaphragm into the container removed the headspace and caused some redistribution of the product, the resulting sealed package thereby being substantially hydraulically solid and void-free, with little or no permanent gas. The stretching of the sheet was non-elastic, so that when the fluid pressure was removed the enclosure was substantially stress-free.

Figure 1:
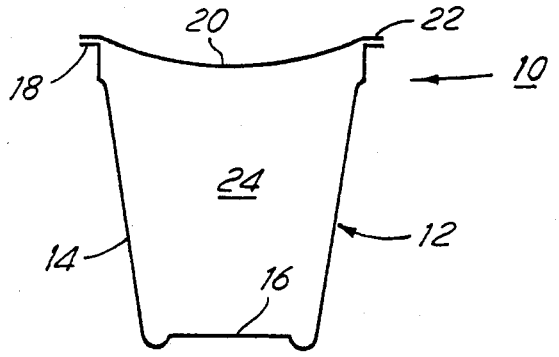
FIG. 1 shows diagrammatically, in a vertical, diametral cross section, a package after filling and closing and before being subjected to a retorting process, the package comprising a thermoplastics container made by thermoforming from a plastics laminate, and a diaphragm closure heat-sealed to the container rim and enclosing a liquid or semi-liquid food product within the container.

Such heat-sealing process has been described fully in the British Patent Specification No. GB 2067157B, to which the reader's attention is directed for further information concerning that process. In the resultant package, the heat-sealed diaphragm had a smoothly curved, shallow, outwardly concave appearance, and lay wholly in contact with the product in the container as mentioned above. FIG. 1 shows a vertical, diametral cross-section of a typical one of the test packages produced. In that Figure, the sealed enclosure 10 of the package contains a product 24 and comprises a unitary container 12 having a side wall 14, a base 16 and an outturned, annular rim 18, and a closure diaphragm 20 having its peripheral margin 22 heat-sealed to the container rim 18.

TEST SERIES 1

For this first series of tests the containers were closed by diaphragms formed of 40 micron aluminium foil coated with a 50 micron layer of high density polyethylene to enable the diaphragm to be heat-sealed to the container rim.

In order to provide the packages with a wide range of base thicknesses the containers were formed from two thickness of laminate, namely 1.8 mm and 2.5 mm; moreover, the containers formed from the 1.8 mm laminate were made using two different sets of thermoforming conditions, which gave them either relatively thin or relatively thick bases. A four-cavity thermoforming mould was used for each laminate, and for the 2.5 mm laminate the particular mould cavity employed was noted for each container.

The test packages were subjected to three different but conventional retorting processes, but it was found after completion of those processes that all of the packages had suffered some substantial and readily visible deformation such that the containers were considered to be commercially unacceptable. Table 1 below gives the results obtained.

TABLE 1

| Container Type | Container Weight (g) | Distortion (%) Container | Distortion (%) Diaphragm |
|---|---|---|---|
| 1.8 mm Laminate | | | |
| Thin base | 6.5 g–6.8 g | 100 | 0 |
| Thick base | | 86 | 14 |
| 2.5 mm Laminate Mould Cavity | | | |
| (1) | 9.5 g–10 | 55 | 45 |
| (2) | | 15 | 85 |
| (3) | | 28 | 72 |
| (4) | | 67 | 33 |

Measurements showed that the containers had suffered a degree of volume shrinkage lying within the range 3%–8%, and it was evident that this shrinkage had correspondingly reduced the volume available for the product, which accordingly had caused gross and commercially unacceptable deformation of the enclosure. Usually the deformation occured either at the base 16 of the container 12, or at the closure diaphragm 20; in a few cases, however, the container deformed at its side wall 14. Container base deformation and diaphragm deformation are illustrated in FIGS. 2 and 3 respectively.

Figure 2:
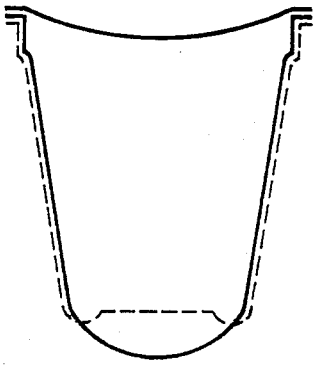
FIGS. 2 and 3 show two packages of the kind shown in FIG. 1, as they appeared when closed by a metal diaphragm and after having been subjected to a retorting process.

From a comparison FIG. 2 with FIG. 1, it will be observed that whereas in FIG. 2 the inwardly dished shape of the closure diaphragm 20 is seemingly unaltered by the retorting process, the base 16 of the container 12 has been forced outwardly by the enclosed product whilst in a heat-softened condition, so as to be downwardly bulging in a manner that renders the enclosure mechanically unstable when placed base-down on to a horizontal surface, and, moreover, gives the container a "blown" appearance. Thus, the retorting process has rendered this package unsuitable for sale to a customer. This mode of deformation was typical of the packages having their containers formed from the thinner(1.8 mm) laminate, although some containers formed from the thicker(2.5 mm) laminate were similarly affected.

Figure 3:
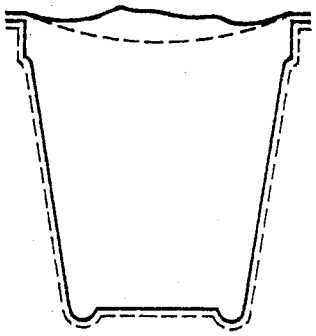

On the other hand, it will be seen that whereas the container base 16 in FIG. 3 is seemingly unaltered compared with that of FIG. 1, the closure diaphragm 20 has been pushed upwardly by the enclosed product so as to exhibit a wrinkled, uneven and bulging appearance, which was again considered to be unacceptable to a potential customer. This mode of deformation was typical of the packages having their containers formed from the thicker(2.5 mm) laminate, but it also occurred in the few containers formed from 1.8 mm laminate which were not subject to container deformation. Thus, all of the retorted packages having the metal diaphragms were considered to have been rendered unacceptable to potential customers by the retorting process.

From Table 1 above it will be seen that the containers produced in the cavities 2 and 3 showed significantly better performance than the containers from the cavities 1 and 4 in relation to container base deformation. This disparity can be explained by the fact that the containers from the cavities 2 and 3 had on average thicker and more uniform base walls than the containers from the cavities 1 and 4, and so were better able to withstand any stresses generated in the package during retorting; nevertheless a substantial proportion of them did suffer gross base distortion. In Test Series 2, a report of which now follows, the cavities were combined together as groups 1/2 and 3/4 so that the containers from the two groups would have similar ranges of base thickness.

TEST SERIES 2

For this series of tests forty containers were moulded from the same 2.5 mm laminate as was used in Test Series 1, using the same four-cavity thermoforming mould as was used before for that laminate. The cavity appropriate to each container was noted. The twenty containers moulded in cavities 3 and 4 were then closed using the same lidding material and closing process as was used in Test Series 1; the twenty containers from cavities 1 and 2 were closed using essentially the same closing process as before, but with an all-plastics (clear) lidding material formed of 15 micron polyethylene terephthalate (PET) extrusion-laminated with 70 micron cast polypropylene.

The closed packages were retorted in an underwater retort for 60 minutes at a temperature of 240° F. and a pressure of 30 p.s.i. Before retorting all the packages had the appearance shown in FIG. 1. After retorting the packages with a metal diaphragm again had an appearance such as is depicted in FIG. 2 or FIG. 3, and were considered to be commercially unacceptable; however, the containers with a plastics diaphragm had an appearance usually as shown in FIG. 4 but occasionally as shown in FIG. 5.

It will be seen from FIGS. 4 and 5 that the bases 16 of all the plastics-lidded containers 12 of this second series of tests had resisted the internal forces produced during retorting; in fact, the containers showed no visible signs of deformation anywhere. FIG. 4 depicts a typical container after retorting, and shows that the diaphragm had still retained its original smoothly curved concave appearance. The concavity of the diaphragm had been reduced, but this change was not apparent to a potential consumer of the packaged product; moreover, there was no wrinkling, folding, blistering or balooning of the diaphragm such as might throw doubt on the condition of the packaged product, or otherwise generate consumer resistance.

FIG. 6 shows the containers used in Test Series 2 in relation to the mould cavities in which they were formed and as plotted against base thickness. For each container the respective line represents the range of thickness which were measured at a number of points on the container base. The greater and more uniform base thickness given by cavities 2 and 3 can readily be seen. The results are shown in tabular form in Table 2 as follows:

TABLE 2

| | Diaphragm | Container Base Thickness (mm) | Distortion (%) container | Distortion (%) Diaphragm |
|---|---|---|---|---|
| Cavity 1 | Thermoplastics | 0.74–1.57 | 0 | 0 |
| Cavity 2 | Thermoplastics | 1.22–1.81 | 0 | 0 |
| Cavity 3 | Metal | 1.22–1.64 | 0 | 100 |
| Cavity 4 | Metal | 0.63–1.28 | 100 | 0 |

The reduction in the concavity (or degree of dishing) of the plastics diaphragms in this Test Series 2 was dependent upon the volume shrinkage of the containers in relation to the volume of the headspace closed by the diaphragms. It was found that the reduction could be adjusted within wide limits as desired, by varying the fill level of the product and therefore the headspace volume, the maximum reduction resulting in the generally plane diaphragm shown in FIG. 5. In this respect it is to be noted that a convex, outwardly bulging diaphragm was considered to be commercially unacceptable from the viewpoints of stackability, ease of transport, and customer acceptance.

Applicants believe that the lack of any unacceptable deformation of the plastics-lidded packages caused by the retorting operation can be attributed to the following reasons:

(1) During retorting, the shrinkage of the diaphragm operates in the sense to increase the volume of the enclosure and so counteracts volume loss of the enclosure caused by the volume shrinkage of the container, thereby tending to reduce the pressure within the enclosure;

(2) Because of the smaller material thickness and thermal capacity of the diaphragm material in relation to the container material, the thermal response of the diaphragm to the retorting temperatures is faster than that of the container, and during retorting the internal pressure within the enclosure is not merely substantially smaller than it would have been with a non-thermoretractile (e.g. metal) diaphragm material, but for at least a substantial part of the retorting operation it may in fact be negative in relation to the ambient pressure of the retort;

(3) Despite the limpness of the container and diaphragm materials induced by the retorting operation, the enclosure is able to sustain substantial negative pressures without deformation, and the package therefore survives the retorting operation with no deformation of the container and with the diaphragm concavity reduced so as to compensate for the volume shrinkage of the container;

(4) After retorting, when the package has cooled to normal room temperatures, the plastics materials of the container and diaphragm regain their rigidity and the package is left in a substantially stress-free condition even though the diaphragm material may not have reverted fully to the plane condition in which it was originally formed.

It was thus believed that reversion of their dished thermoplastics diaphragms towards a substantially planar (undished) shape during retorting had rendered the plastics-lidded containers of Test Series 2 commercially acceptable after retorting.

TEST SERIES 3

30 containers thermoformed in the same four-cavity mould from the 2.5 mm laminate used in the Series 1 and 2 Tests were subjected indiscriminately to the same closing and retorting operations as the containers of the Series 2 Tests. After retorting, the 11 containers which were plastics-lidded were all found to be commercially acceptable and in particular showed no visible container deformation; the 19 foil-lidded containers, however, all showed container or diaphragm deformation and were considered to be commercially unsatisfactory.

The minimum base thickness of the 30 containers of the Series 3 Tests was 0.65 mm, and Applicants believe that this is about the minimum figure for containers base thickness which would have ensured that a high proportion (e.g. 99.9% or more) of the particular containers under test would have been commercially acceptable after retorting. In this respect it is to be noted that the minimum base thickness of the successful, plastics-lidded containers of Test Series 2 was 0.74 mm.

TEST SERIES 4

66 containers thermoformed from 1.8 mm sheet were closed, some by metal diaphragms and the remainder by plastics diaphragms, using the closing process of the other Test Series. After retorting using the retort process employed for Series 2 and 3 it was found, as expected, that none of the containers which were foil-lidded was deemed to be commercially satisfactory. However, about one half of the 28 plastics-lidded containers were found to be commercially satisfactory after retorting; the failures were attributable to container deformation caused by insufficient container wall, in particular base, thickness, and in this respect it is to be noted that the base thicknesses of the containers were found to lie within a range of between 0.50 mm and 0.81 mm, and therefore spanned the 0.65 mm value mentioned in relation to Test Series 3 above. The results of Test Series 4 are therefore believed to lend support to 0.65 mm being approximately the minimum value of the container wall thickness which was likely to have been commercially acceptable for the containers tested.

Various plastics materials may be used for the thermoretractile diaphragm closures of packages in accordance with the invention. Usually, the closure material will be of a laminated construction, although this is not essential. In one proposal the closure material is a five layer structure comprising outer skin layers of polypropylene and an intermediate barrier layer of polyvinylidene chloride (PVDC) which is bonded by thin adhesive layers to the polypropylene layers on either side.

The thermoretractibility of the diaphragm closures of the packages in accordance with the invention may be imparted entirely by an operation to stretch the diaphragm material into contact with the product as particularly described above in relation to the tests conducted by Applicants. Usually, the diaphragm material will have a degree of retractibility imparted to it during its original manufacture, and this inherent retractibility is additive to any retractibility created by the stretching operation. Within the scope of the invention, however, are packages and methods for making them wherein the diaphragm is wholly or partially dished prior to its application and heat-sealing to the container, for example by a thermoforming operation on a relatively thick and usually self-supporting thermoplastics diaphragm material; in such circumstances thermoretractibility may again be conferred on the diaphragm on formation to its dished configuration, and possibly also during the original formation of the material.

To give it its required property of thermoretractibility the diaphragm will usually be made wholly of thermoplastics material and the enclosure may therefore be fully microwaveable. The diaphragm may nevertheless be partially metallic, but any metal content which the diaphragm material does possess should not be such as to destroy the thermoretracticle nature of the diaphragm material; it will therefore typically be in the form of a thin, vapour-deposited coating or discrete particles added for gas barrier or cosmetic reasons.

Although the containers used in the tests described above had volume shrinkages lying within the range 3% -8%, Applicants believe that the invention may be valuable for use with containers having volume shrinkages of from 1% upwards. As previously mentioned, the containers may be formed by a thermoforming operation on thermoplastics sheet, or by another plastics moulding operation; moreover, the base of the container need not be integral with the side wall.

In one application the invention is used to relieve internal pressure and prevent side wall distortion during retorting of a container having a generally cylindrical side wall cut from a stretch-blow moulded PET (polyethylene terephthalate) tube. One end of the container, destined to form what may be considered as the container base, is closed by a rigid metal end closure double-seamed to an end of the side wall, the other "top" end of the container being a dished, relatively flexible and thermoretractile, plastics diaphragm which is heat-sealed to a flange formed on the other end of the side wall and which makes full contact with the enclosed product so that the package is hydraulically solid. Although it may have been subject to a heat-setting operation the PET side wall may be subject to some volume shrinkage during retorting, but any resultant reduction in the enclosed volume of the container during that time is counteracted by reversion of the diaphragm towards a plane condition, as has previously been discussed in relation to the all-plastics container. It is to be noted that with this particular container construction the container may be supplied to the food packer with the diaphragm closure attached but plane (i.e. not dished). The packer fills the container with product through the opposite end under vacuum so as to leave an evacuated headspace, double-seams a metal end closure to that end so as to close the container, and subsequent dishes the diaphragm closure inwardly to remove the headspace, render the package hydraulically solid and render the diaphragm thermoretractile.

We claim:

1. A retortable package having a product contained within an enclosure, the enclosure comprising a container having a base and an upstanding side wall extending to a rim, at least the side wall being moulded from thermoplastics material and being subject to shrinkage during a retorting process, the enclosure further comprising a diaphragm which is heat-sealed to the container rim and dished on to the product in the container so as to render the package substantially hydraulically solid, said diaphragm being of thermoplastics material and being heat-shrinkable so as during a subsequent retorting process to shrink and by reducing the concavity of the diaphragm substantially to compensate for volume shrinkage of the container caused by the retorting process.

2. A retortable package according to claim 1 wherein the container base is integral with the container side wall.

3. A retortable package according to claim 2 wherein the container is thermoformed from thermoplastics sheet material.

4. A retortable package according to claim 1 wherein the container base is rigid and of metal, and secured to the side wall by double-seaming.

5. A retortable package according to claim 3 wherein the container is formed from multilayer sheet comprising polypropylene outer layers and an intermediate barrier layer, the base thickness of the container being at least 0.65 mm.

6. A retortable package according to claim 1 arranged so that when said package is subsequently retorted said concavity of the diaphragm is only partially eliminated and the diaphragm therefore still has a dished configuration.

7. A method of making a retortable package of a product comprising the steps of:

(a) forming a container to have a base and an upstanding side wall extending to a rim, at least the side wall being moulded from thermoplastics material and being subject to shrinkage during a retorting process;

(b) charging the container with the product to leave a headspace below the rim;

(c) heat-sealing a thermoplastics diaphragm peripherally to the rim;

(d) rendering the diaphragm material dished so as to cause the diaphragm, after heat-sealing, to occupy the headspace and make full contact with the product, the package thereby being rendered hydraulically solid; and (e) rendering the diaphragm heat-shrinkable so as during a retorting process on the hydraulically solid package to shrink and, by reducing the concavity of the diaphragm, substantially to compensate for volume shrinkage of the container caused by the retorting process.

8. A method as claimed in claim 7 which further includes creating a vacuum in the headspace prior to the heat-sealing step, the diaphragm being formed from a thermoplastics sheet which is shaped to a dished configuration after the heat-sealing step, the heat-shrinkability of the diaphragm being at least partly created by the shaping operation.

9. A method as claimed in claim 7 wherein the diaphragm is shaped to a dished configuration prior to being heat-sealed to the container rim, the dishing operation conferring at least part of the heat-shrinkability to the diaphragm.

10. A method as claimed in claim 8 wherein the thermoplastics sheet is rendered partly heat-shrinkable before being rendered dished.

11. A method as claimed in claim 9 wherein the thermoplastics sheet is rendered partly heat-shrinkable before being rendered dished.

* * * * *